US010267484B2

(12) United States Patent
Qiu et al.

(10) Patent No.: US 10,267,484 B2
(45) Date of Patent: Apr. 23, 2019

(54) LIGHT APPARATUS HAVING CONTROLLED SEQUENCED LIGHT PATTERNS

(71) Applicant: Evergreen Enterprises of Virginia, LLC, Richmond, VA (US)

(72) Inventors: Fei Qiu, Richmond, VA (US); Lin hui Sun, Ningbo (CN); Brittany Toler, Midlothian, VA (US)

(73) Assignee: Evergreen Enterprises of Virginia, LLC, Richmond, VA (US)

( * ) Notice: Subject to any disclaimer, the term of this patent is extended or adjusted under 35 U.S.C. 154(b) by 0 days.

(21) Appl. No.: 15/711,036

(22) Filed: Sep. 21, 2017

(65) Prior Publication Data

US 2019/0086055 A1 Mar. 21, 2019

(51) Int. Cl.

| | |
|---|---|
| ***F21V 5/00*** | (2018.01) |
| ***F21V 17/00*** | (2006.01) |
| ***F21V 23/00*** | (2015.01) |
| ***F21W 121/00*** | (2006.01) |
| ***F21Y 115/10*** | (2016.01) |

(52) U.S. Cl.

CPC ..... *F21V 5/008* (2013.01); *F21V 17/00* (2013.01); *F21V 23/003* (2013.01); *F21W 2121/00* (2013.01); *F21Y 2115/10* (2016.08)

(58) Field of Classification Search

CPC ..... F21V 5/008; A47G 2033/0827; F21S 4/10

See application file for complete search history.

(56) References Cited

U.S. PATENT DOCUMENTS

| | | | | |
|---|---|---|---|---|
| 3,949,350 | A * | 4/1976 | Smith | F21S 6/002 362/231 |
| 7,064,498 | B2 * | 6/2006 | Dowling | A61N 5/0616 315/291 |
| 7,788,833 | B2 | 9/2010 | Hauck et al. | |
| 9,686,839 | B1 | 6/2017 | Chern et al. | |

(Continued)

FOREIGN PATENT DOCUMENTS

| | | |
|---|---|---|
| CN | 201861245 U | 6/2011 |
| CN | 203177044 U | 9/2013 |

*Primary Examiner* — Alexander K Garlen

(74) *Attorney, Agent, or Firm* — Jordan IP Law, LLC; Todd A. Vaughn

(57) ABSTRACT

A light apparatus that includes a light assembly having a control module to control an operating mode of light sources in a light array, including control a sequence of light and an intensity of light emitted from each light source in the array. A housing assembly for the light assembly includes an inner housing having a first material layer defining a first faceted member to receive the light assembly and permit emission of light from the light sources therethrough, and an outer housing having a second material layer defining a second faceted member to receive the inner housing to refract and project the light emitted through the inner housing in a predetermined or random direction and predetermined or random pattern. The predetermined or random pattern includes a patterned shadow formed from an internal refraction of light in different directions as light passes through the second material layer, thereby creating a visual appearance of dynamic movement of the predetermined or random pattern relative to a surface to be illuminated or an area in three-dimensional space to be illuminated.

18 Claims, 7 Drawing Sheets

(56) References Cited

U.S. PATENT DOCUMENTS

| | | | | |
|---|---|---|---|---|
| 9,689,544 | B2 | 6/2017 | Green, Jr. et al. | |
| 2005/0243560 | A1* | 11/2005 | Chen | F21S 10/00 362/328 |
| 2006/0007692 | A1* | 1/2006 | Hsien | F21V 5/00 362/382 |
| 2007/0230168 | A1* | 10/2007 | Cutler-Bass | F21L 4/04 362/205 |
| 2011/0116274 | A1* | 5/2011 | Tsai | A47G 33/0836 362/311.13 |
| 2012/0224363 | A1* | 9/2012 | Van De Ven | H01L 33/505 362/231 |
| 2015/0163876 | A1* | 6/2015 | Zhang | H05B 33/0803 362/235 |
| 2015/0184844 | A1* | 7/2015 | Zhang | F21V 33/0028 362/96 |
| 2016/0327236 | A1* | 11/2016 | Benitez | F21V 5/04 |

* cited by examiner

LIGHT APPARATUS HAVING CONTROLLED SEQUENCED LIGHT PATTERNS

TECHNICAL FIELD

Embodiments relate to a light apparatus that includes a light assembly having a control module to control an operating mode of light sources in a light array, including control of a sequence of light and an intensity of light emitted from each light source in the array. A housing assembly for the light assembly includes an inner housing having a first material layer defining a first faceted member to receive the light assembly and permit emission of light from the light sources therethrough, and an outer housing having at least one second material layer defining at least one second faceted member to receive the inner housing to refract and project the light emitted through the inner housing in a predetermined or random direction and a predetermined or random pattern. The predetermined or random pattern includes a patterned shadow formed from an internal refraction of light in different directions as light passes through the second material layer, thereby creating a visual appearance of dynamic movement of the predetermined or random pattern relative to a surface and/or an area in three-dimensional space.

BACKGROUND

Lighting devices such as, for example, lanterns, may be used to illuminate and decorate homes and yards.

DRAWINGS

The summary of embodiments, as well as the detailed description is better understood when read in conjunction with the accompanying drawings that illustrate one or more possible embodiments of embodiments, in which.

DESCRIPTION

Figure 1:
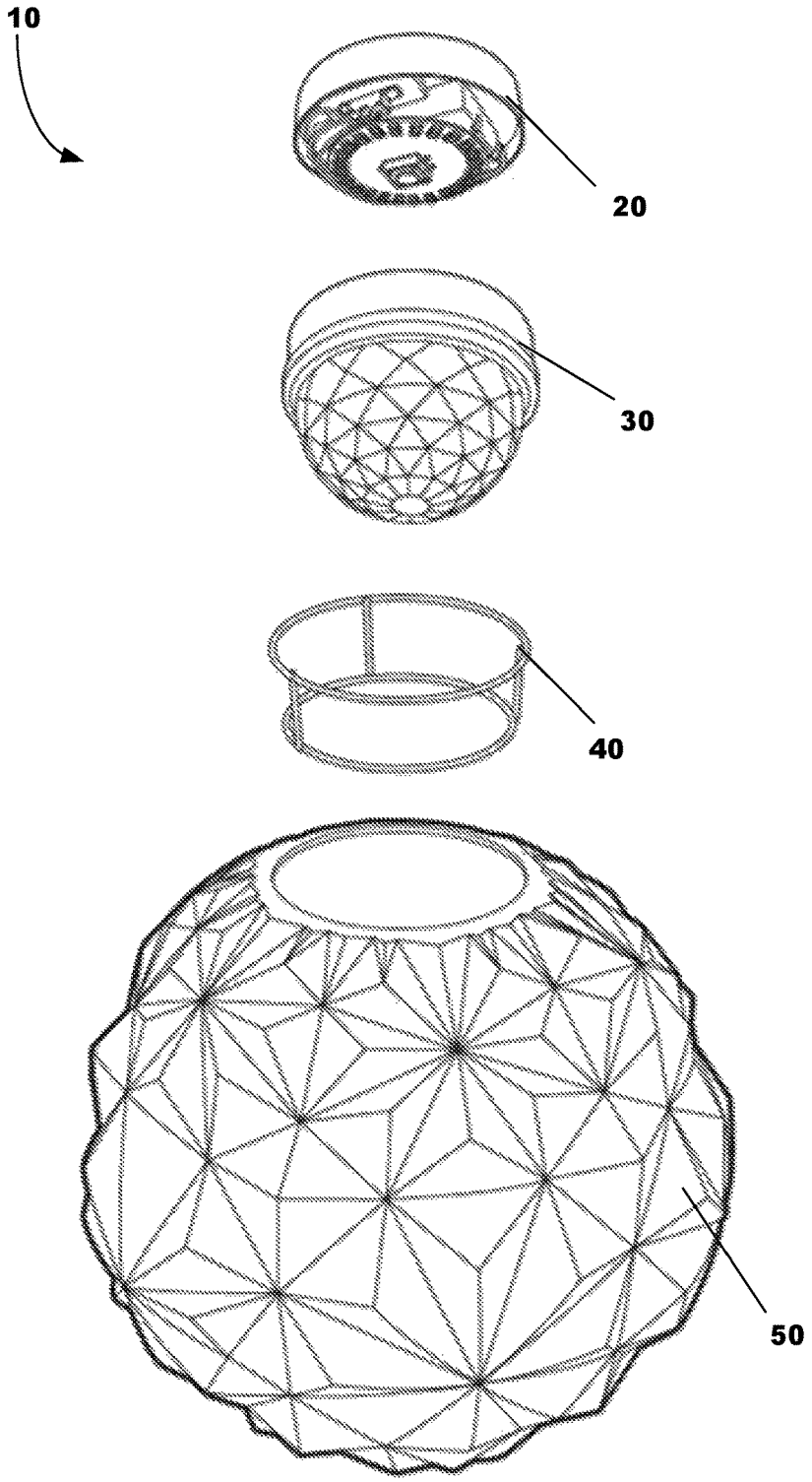
FIG. 1 is an exploded view of a light apparatus, in accordance with embodiments.

As illustrated in FIG. 1, a light apparatus 10 is provided in accordance with embodiments. The light apparatus 10 comprises a light assembly 20 to emit light, an inner housing 30 configured to receive and support the light assembly 20, a carrier 40 to suspend the inner housing 30 (including the light assembly 20) in an inner volume defined by an outer housing 50. Such a light apparatus 10 may be used for placement on an underlying support surface in a room of a home, or an open area of a lawn, patio, garden or the like.

Alternatively or additionally, the light apparatus 10 may be suspended on a suspension point in room of a home, an open lawn area, garden, and the like.

Figure 2:
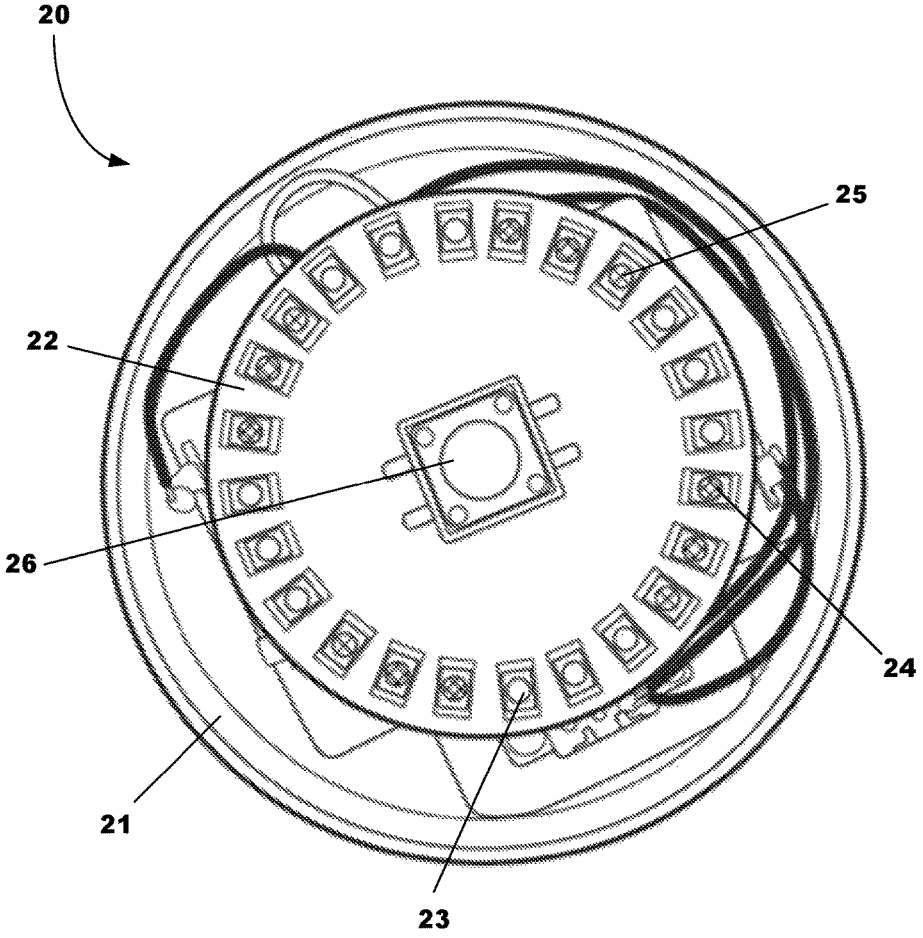
FIG. 2 is a top view of the light assembly of the light apparatus of FIG. 1, in which the LEDs are mounted directly to the PCB board.

As illustrated in FIG. 2, the light assembly 20 comprises a base 21, printed circuit board (PCB) 22 supported by or mounted on the base 21, an array of light sources 23, 24, 25 operatively connected to the PCB 22 (FIG. 2), and a control module 26 to control an operating mode of the light sources 23, 24, 25.

Figure 3:
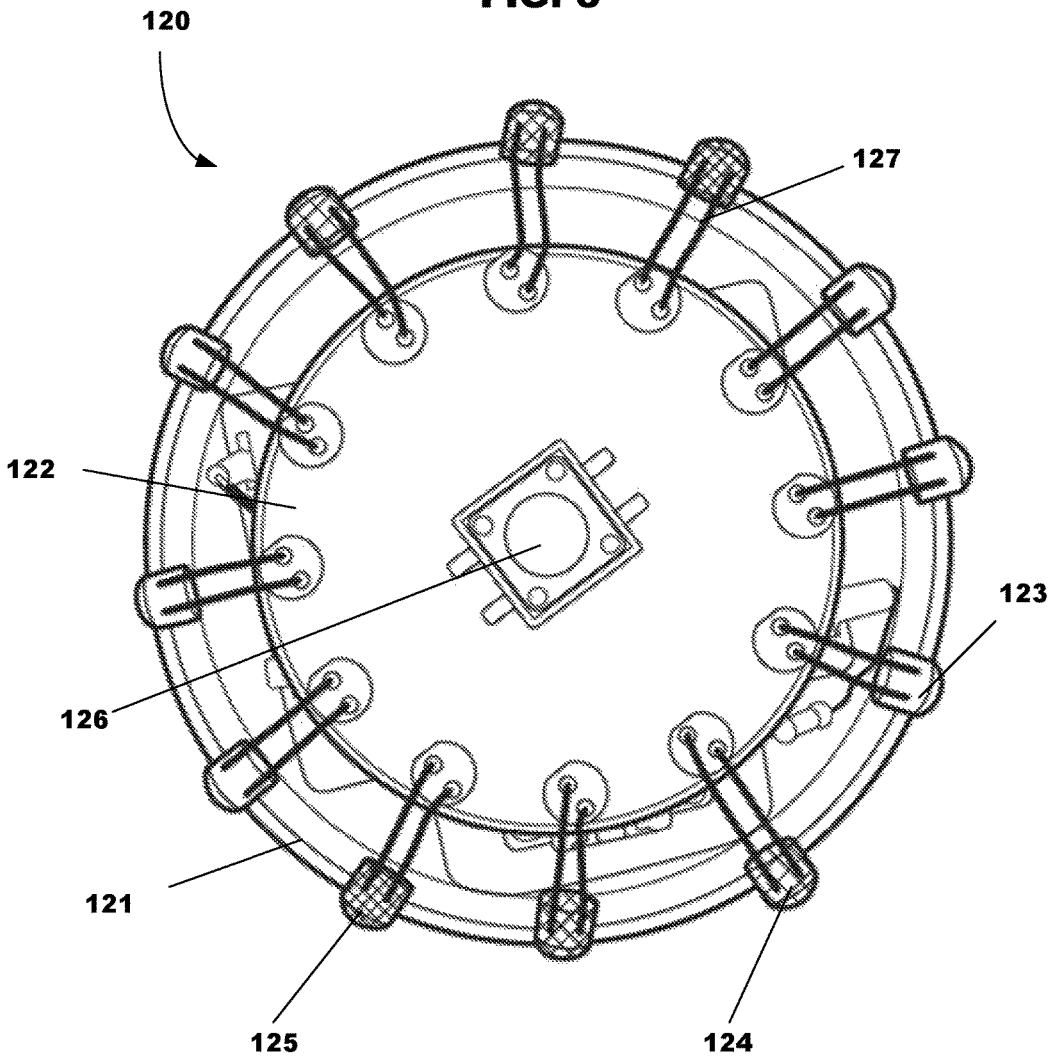
FIG. 3 is a top view of a light assembly in which the LEDs are mounted indirectly to the PCB board, in accordance with embodiments.

As illustrated in FIG. 3, the light assembly 120 comprises a base 121, printed circuit board (PCB) 122 supported by or mounted on the base 121, an array of light sources 123, 124, 125 operatively connected to the PCB 122 indirectly via electrical connectors 127, and a control module 126 to control an operating mode of the light sources 123, 124, 125.

In accordance with embodiments, the control module 26, 126 comprises a processor and a computer readable storage medium to store a set of instructions which, if executed by the control module, cause the control module 26, 126 to control an operating mode of the light sources 23-25, 123-125. For example, the control module 26, 126 may be programmable to control a sequence of light and an intensity of light emitted from each light source 23-25, 123-125 in the array.

Additionally or alternatively, the control module 26, 126 may be programmable to wirelessly control the light assembly 20, 120. Such wireless control may include, for example, infrared, radio frequency (RF), WiFi, Bluetooth™ and any combination thereof.

Additionally or alternatively, the control module 26, 126 may be programmable to variably control a transition time between a sequencing of light and an intensity of light emitted from light sources 23-25, 123-125 in the light array 20, 120.

Such control may be done either manually and/or automatically via an actuator controlled by a control unit, and/or remotely by a handheld and portable controller. Embodiments, however, are not limited thereto and may encompass other control methods of control which fall within the spirit and scope of the principles of this disclosure.

Additionally or alternatively, the control module 26, 126 may be programmable to control a sequence of light and an intensity of light emitted from each light source 23-25, 123-125 in order to create a visual effect that the emitted light is dynamically moving (e.g., "motion effect illumination," "dynamic illumination," "animated illumination," "transitional illumination") relative to a surface and/or an area in three-dimensional space (e.g., the environment). In accordance with embodiments, the control module 26, 126 may be programmable to: (i) control the operating mode of an individual light source 23-25, 123-125 independent of the others, and/or control the operating mode of a predetermined or random number of light source 23-25, 123-125 simultaneously. The operating mode may include, but is not limited to, the active state (i.e., "ON" designation in which a power source is activated), and an inactive state (e.g., "OFF" designation in which a power source is deactivated) of the light sources 23-25, 123-125. In accordance with embodiments, the active state may include a dimming state whereby partial (i.e., not full) power is used for the light sources 23-25, 123-125.

In accordance with embodiments, the light sources 23-25, 123-125 may comprise light emitting diodes (LED) mounted (e.g., as "Surface Mounted Diodes" (SMD)) in a predetermined or random physical pattern or arrangement on the base 21, 121 or the surface of the PCB 22, 122. Embodiments, however, are not limited thereto, and may encompass other light sources that fall within the spirit and scope of the principles of this disclosure. The PCB 22, 122 may be arranged for electrical communication a power source such as, for example, at least one of a solar power source, a battery power source, an electrical power source, or an AC adapter to regulate the voltage passing to and from the power source and the light sources 23-25, 123-125. The battery source may comprise a rechargeable battery to be charged and discharged by the PCB 22, 122.

Figure 4:
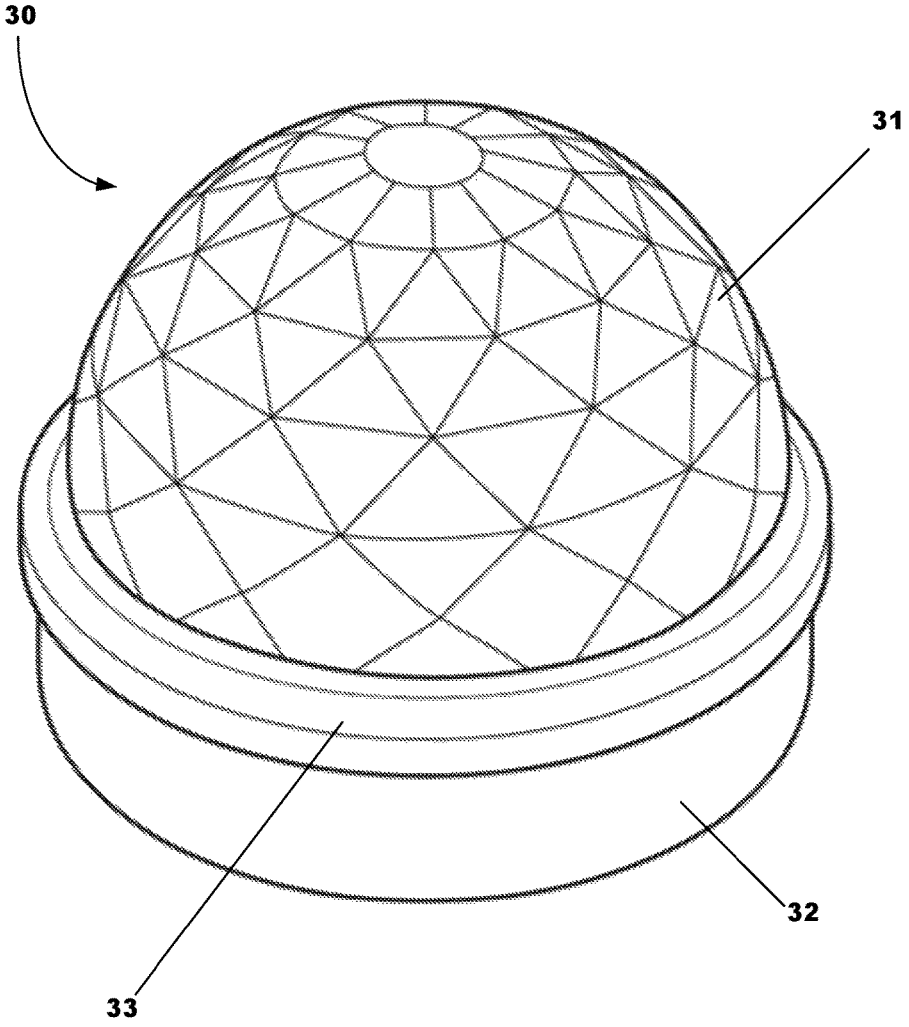
FIG. 4 is a perspective view of the inner housing of the light apparatus of FIG. 1.

As illustrated in FIG. 4, the inner housing 30 comprises a first material layer 31 connected to a base 32. The base 32 includes a stepped portion 33 adjacent to the first material layer 31. The stepped portion 33 has an outermost diameter that is greater than the outermost diameter of the base 32 to enable the inner housing 30 to be suspended in the outer housing 50. Although the illustrated example includes a base 32 having a stepped portion 33, embodiments are not limited thereto, and may encompass other structural configurations that fall within the spirit and scope of the principles of this disclosure. Although the first material layer is illustrated having a spherical cross-section or structural configuration, embodiments are not limited thereto, and may encompass other cross-sections or structural configurations that fall within the spirit and scope of the principles of this disclosure. As an example, the first material layer 31 may have a cross-section or structural configuration that is spherical, a cylindrical, a rectangular, or combinations thereof.

Figure 5:
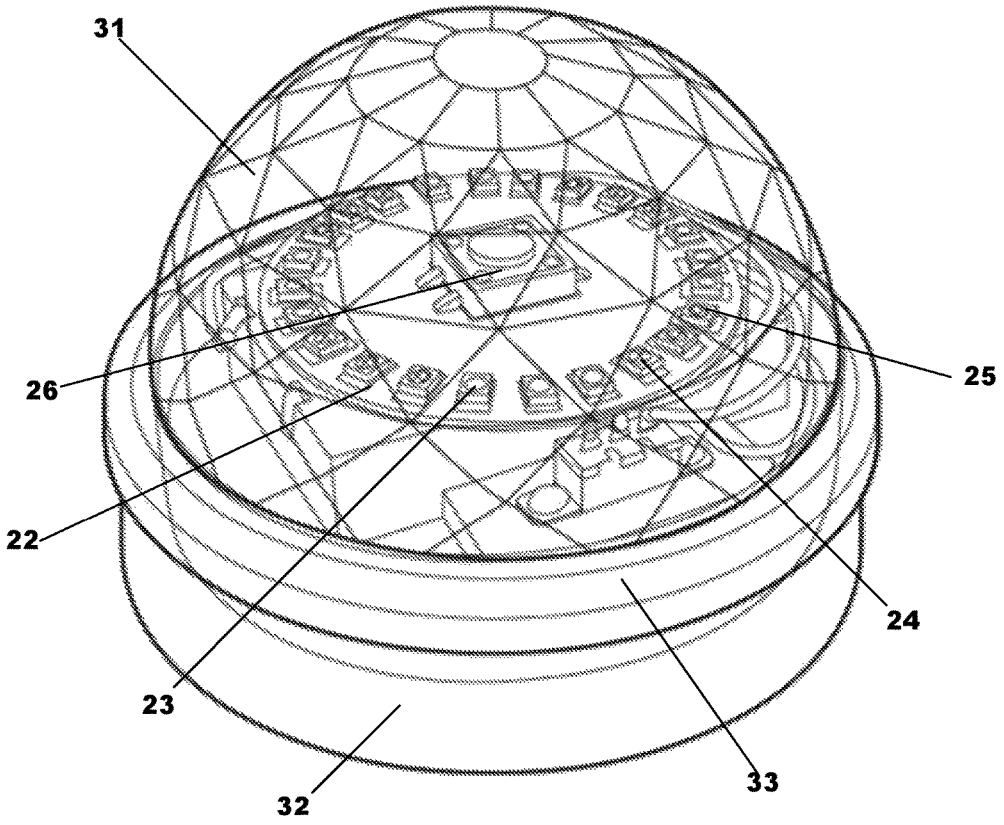
FIG. 5 is a perspective view of the light assembly mounted in the inner housing of the light apparatus of FIG. 4.

As illustrated in FIG. 5, in accordance with embodiments, the first material layer 31 may be configured as a faceted structure or member that defines an inner volume or space sized to receive and support the light assembly 20. In accordance with embodiments, the light sources 23-25, 123-125 may be removably connected using a mechanical connector to the base 32, such as, for example, a rib section of the base 32.

In accordance with embodiments, the first material layer 31 comprises a translucent material or a transparent material that permits emission of light from the light sources 23-25, 123-125 therethrough. The first material layer 31 may comprise a plurality of surface regions which are arranged on different planes and angles to refract and project light in different directions. As an example, the surface of the first material layer 31 may comprise a plurality of projections extending outwardly at various angles that permit refraction of light therefrom in the predetermined or random direction and/or the predetermined or random pattern. Embodiments, however, are not limited thereto and may encompass other patterns that fall within the spirit and scope of the principles of this disclosure.

Figure 6:
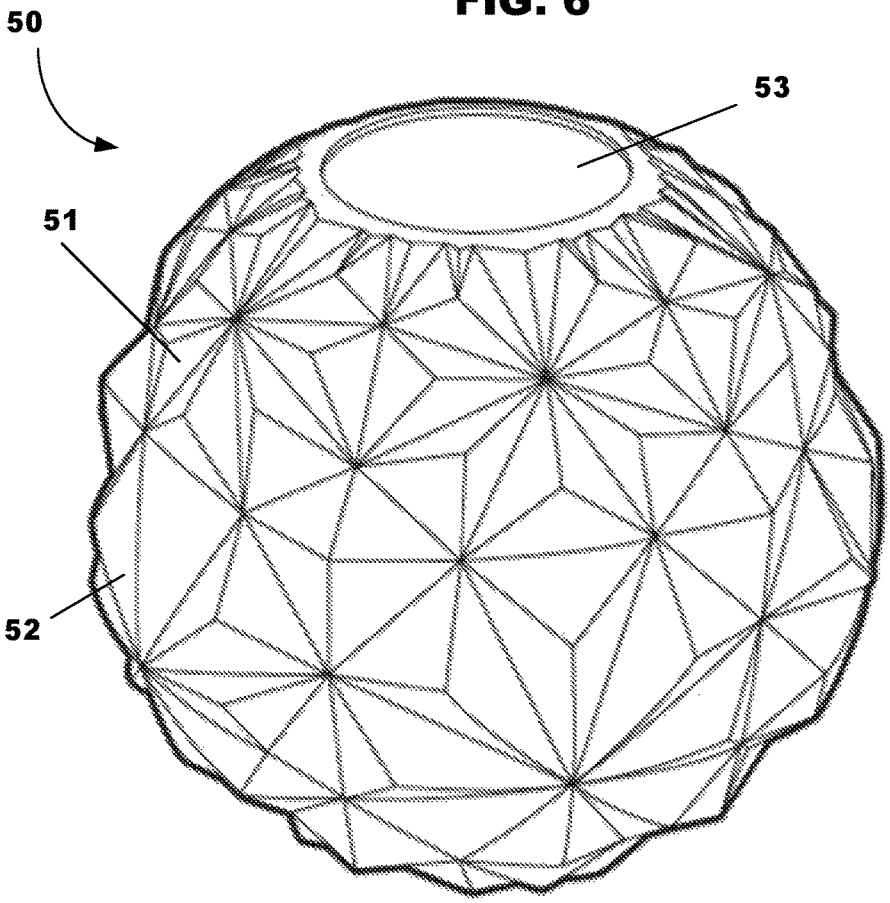
FIG. 6 is a perspective view of the outer housing of the light apparatus of FIG. 1.

As illustrated in FIG. 6, in accordance with embodiments, the outer housing 50 comprises at least one second material layer 51 that may be configured as a faceted member having a plurality of projections 52 extending outwardly at various angles that permit refraction of light therefrom. Although the illustrated example includes projections 52 having a pyramid-type cross-section, embodiments are not limited thereto, and may encompass other geometric cross-sections that fall within the spirit and scope of the principles of this disclosure. Although the second material layer 51 is illustrated having a spherical cross-section or structural configuration, embodiments are not limited thereto, and may encompass other cross-sections or structural configurations that fall within the spirit and scope of the principles of this disclosure. As an example, the first material layer 51 may have a cross-section or structural configuration that is spherical, a cylindrical, a rectangular, or combinations thereof. Alternatively or additionally, the surface of the first material layer 51, for example, may include a plurality of etched grooves that also permit the same visual effect of illuminated light.

The second material layer 51 includes an opening 53 sized to receive and support the inner light assembly 20 and inner housing 30 via a carrier or bracket 40 that permits suspension of the inner housing 30 into the space. The carrier 40 may be sized to fit in the opening 53 of the outer housing 50, and includes rings that are to receive and support the inner housing 30 at the stepped portion 33, thereby enabling suspension of the inner housing 30. Alternatively, the inner housing 30 may be received directly by the outer housing 50 without need for a mechanical device such as a carrier 40. Moreover, while embodiments illustrate the inner housing 30 removably attached to the outer housing 50, embodiments are not limited thereto, and may encompass other attachments that fall within the spirit and scope of the principles of this disclosure. As an example, embodiments may include a permanent connection between the inner housing 30 and the outer housing 50.

In accordance with embodiments, the second material layer 51 comprises a translucent material or a transparent material that permits emission of light from the light sources 23-25, 123-125 that has passed through the first material layer 31. The second material layer 51 may comprise a plurality of surface regions which are arranged on different planes to refract and project or otherwise scatter light in different directions onto a surface or an area in three-dimensional space environment.

Figure 7:
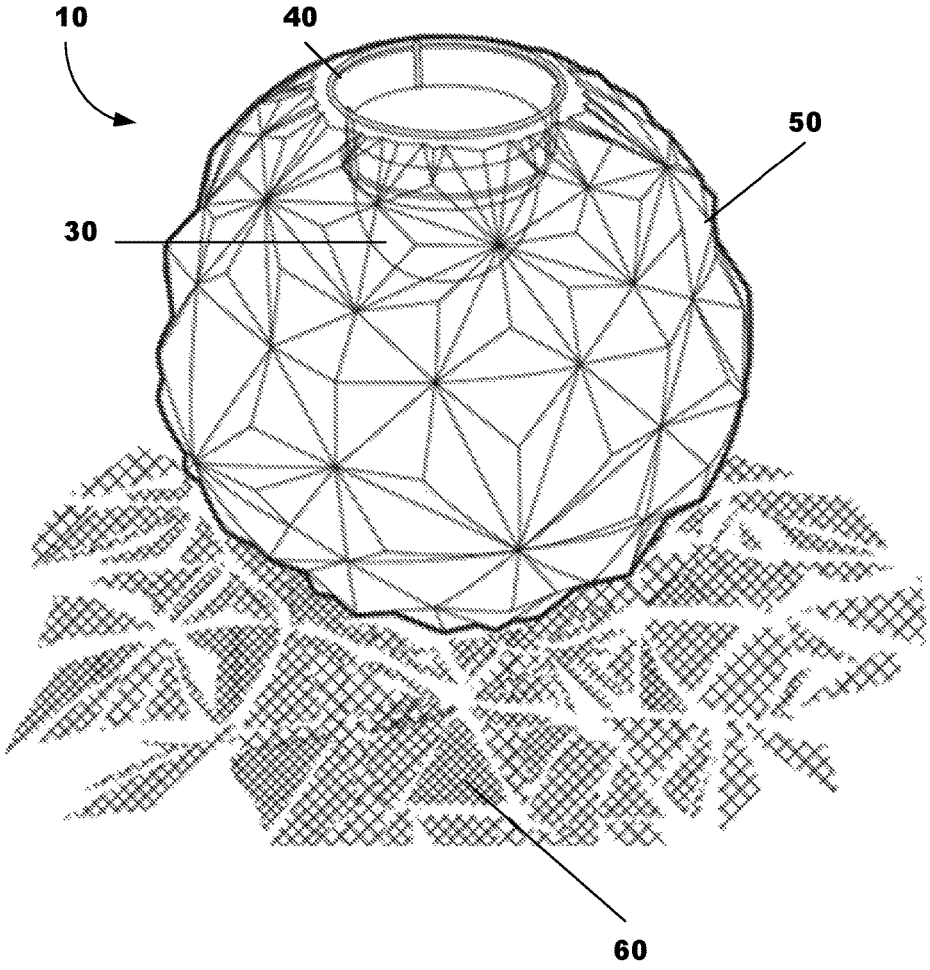
FIG. 7 is a perspective view of a light assembly and an emitted light pattern on a surface, in accordance with embodiments.

As illustrated in FIG. 7, for example, the surface of the second material layer 51 may be configured to refract and project light emitted therethrough in a predetermined or random direction and a predetermined or random pattern of light and shadow 60. As an example, the surface of the second material layer 51 may comprise a plurality of projections set at various angles that permit refraction of light therefrom in the predetermined or random direction and the predetermined or random pattern 60. The pattern so produced in accordance with embodiments is to have the visual appearance of dynamic movement and change, due to the refraction of light by the second material layer 51, and the controlled and variable sequencing and illuminative intensity of individual light sources 23-25, 123-125 by the control module 26, 126 to give a visual appearance of dynamic movement of the pattern relative to a surface and/or an area in three-dimensional space. The predetermined or random pattern 60 may comprise, for example, a patterned shadow and different shades and/or colors of light, and one or more patterned shadows formed from an internal refraction of light in different directions as the light passes through the second material layer 51. Embodiments, however, are not limited thereto and may encompass other patterns that fall within the spirit and scope of the principles of this disclosure. The inner housing 30 and the outer housing 50 may, in accordance with embodiments, have the same structural surface configuration, or alternatively, a different structural surface configuration.

Additional Notes and Examples:

Example One may include a light apparatus, comprising: a light assembly including: (i) an array of light sources to illuminate light; (ii) a control module having a processor and a computer readable storage medium to store a set of instructions which, if executed by the control module, cause the control module to control an operating mode of the light sources, including control a sequence of light and an intensity of light emitted from each light source in the array; and a housing assembly including: (i) an inner housing having a first material layer defining a first faceted member to receive the light assembly and permit emission of light from the light sources therethrough; and (ii) an outer housing having a second material layer defining a second faceted member to receive the inner housing to refract and project the light emitted through the inner housing in a predetermined or random direction and predetermined or random pattern.

Example Two may include the light apparatus of Example One, wherein: the first material layer comprises a translucent material or a transparent material; and the second material layer comprises a translucent material or a transparent material.

Example Three may include the light apparatus of Example One, further comprising a carrier received in the outer housing and configured to suspend the inner housing in the outer housing.

Example Four may include the light apparatus of Example One, wherein the light assembly comprises: a power source including a solar power source, or a battery power source; and a printed circuit board operatively connected to the light sources.

Example Five may include the light apparatus of Example One, wherein the set of instructions which, if executed by the control module, cause the control module to wirelessly control the light assembly.

Example Six may include the light apparatus of Example Five, wherein the wireless control comprises one of infrared, radio frequency, WiFi, Bluetooth and any combination thereof.

Example Seven may include the light apparatus of Example One, wherein the control unit comprises a processor configured to variably control a transition time between a sequencing of light and an intensity of light emitted from each light source in the array.

Example Eight may include the light apparatus of Example One, wherein the predetermined or random pattern comprises a patterned shadow formed from an internal refraction of light in different directions as the light passes through the second material layer, thereby creating a visual appearance of dynamic movement of the predetermined or random pattern relative to a surface or an area in three-dimensional space.

Example Nine may include a light apparatus, comprising: a light assembly including an array of light sources to illuminate light, and a control module to control the light assembly; and a housing assembly including an inner housing material layer defining a first faceted member, and an outer housing material layer arranged spaced from the inner housing material layer to refract and project the light emitted by the light sources in a predetermined or random direction and predetermined or random pattern.

Example Ten may include the light apparatus of Example Nine, wherein: the inner housing material layer comprises a translucent material or a transparent material; and the outer housing material layer comprises a translucent material or a transparent material.

Example Eleven may include the light apparatus of Example Nine, further comprising a carrier received by the housing assembly to suspend the inner housing material layer in the outer housing material layer.

Example Twelve may include the light apparatus of Example Nine, wherein the light assembly comprises: a power source including a solar power source, or a battery power source; and a printed circuit board operatively connected to the light sources.

Example Thirteen may include the light apparatus of Example Nine, wherein the control module comprises a processor and a computer readable storage medium to store a set of instructions which, if executed by the control module, cause the control module to wirelessly control the light assembly.

Example Fourteen may include the light apparatus of Example Nine, wherein the control module comprises a processor and a computer readable storage medium to store a set of instructions which, if executed by the control module, cause the control module to control a sequencing of light and an intensity of light emitted from each light source in the array.

Example Fifteen may include the light apparatus of Example Nine, wherein the predetermined or random pattern comprises a patterned shadow formed from an internal refraction of light in different directions as the light passes through the second material layer, thereby creating a visual appearance of dynamic movement of the predetermined or random pattern relative to a surface or an area in three-dimensional space.

Example Sixteen may include a light apparatus, comprising: a light assembly including an array of light sources to illuminate light, and a control module having a processor and a computer readable storage medium to store a set of instructions which, if executed by the control module, cause the control module to control a sequencing of light and an intensity of light emitted from each light source in the array; an inner housing including a first faceted member to support the light assembly and permit emission of light from the light sources therethrough; and an outer housing including a second faceted member arranged spaced from the first faceted member, and which is to receive the inner housing to refract and project the light emitted through the inner housing in a predetermined or random direction and predetermined or random pattern.

Example Seventeen may include the light apparatus of Example Sixteen, wherein: the inner housing is composed of a translucent material or a transparent material; and the outer housing is composed of a translucent material or a transparent material.

Example Eighteen may include the light apparatus of Example Sixteen, wherein the set of instructions which, if executed by the control module, cause the control module to wirelessly control the light assembly.

Example Nineteen may include the light apparatus of Example Sixteen, wherein the set of instructions which, if executed by the control module, cause the control module to variably control a transition time between a sequencing of light and an intensity of light emitted from each light source in the array.

Example Twenty may include the light apparatus of Example Sixteen, wherein the predetermined or random pattern comprises a patterned shadow formed from an internal refraction of light in different directions as the light passes through the second material layer, thereby creating a visual appearance of dynamic movement of the predetermined or random pattern relative to a surface or an area in three-dimensional space.

The terms "coupled," "attached," or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

REFERENCE NUMERALS

10 Light apparatus
20 Light assembly
21 Base
22 PCB
23 Light source
24 Light source
25 Light source
26 Control module
30 Inner Housing
31 1st material layer
32 Inner Housing base
40 Carrier/bracket
50 Outer Housing
51 2nd material layer
52 Projections
53 Opening of outer housing
60 Predetermined or Random patterns of light and shadow
120 Light assembly
121 Base
122 PCB
123 Light source
124 Light source
125 Light source
126 Control module
127 Electrical connectors

What is claimed is:

1. A light apparatus, comprising:

a light assembly including:

an array of light sources to illuminate light;

a control module having a processor and a computer readable storage medium to store a set of instructions which, if executed by the control module, cause the control module to control an operating mode of the light sources, including control a sequence of light and an intensity of light emitted from each light source in the array;

a housing assembly including:

an inner housing having a first material layer defining a first faceted member to receive the light assembly and permit emission of light from the light sources therethrough, the first material layer being connected to an inner housing base having a stepped portion adjacent to the first material layer, the stepped portion having an outermost diameter that is greater than the outermost diameter of the base; and an outer housing having at least one second material layer defining at least one second faceted member to receive the inner housing to refract and project the light emitted through the inner housing in a predetermined or random direction and predetermined or random patter, the second material layer including an opening; and a carrier received at and supported by the opening of the outer housing, the carrier including rings that are configured to receive and support the inner housing at the stepped portion and thereby suspend the inner housing and the light assembly in the outer housing.

2. The light apparatus of claim 1, wherein:

the first material layer comprises a translucent material or a transparent material; and the second material layer comprises a translucent material or a transparent material.

3. The light apparatus of claim 1, wherein the light assembly comprises:

a power source including one of a solar power source, a battery power source, or an AC adapter power source; and a printed circuit board operatively connected to the light sources.

4. The light apparatus of claim 1, wherein the set of instructions which, if executed by the control module, cause the control module to wirelessly control the light assembly.

5. The light apparatus of claim 4, wherein the wireless control comprises one of infrared, radio frequency, WiFi, Bluetooth and any combination thereof.

6. The light apparatus of claim 1, wherein the control unit comprises a processor configured to variably control:

a transition time between a sequencing of light and an intensity of light emitted from each light source in the array; and an intensity of light from the light sources.

7. The light apparatus of claim 1, wherein the predetermined or random pattern comprises a patterned shadow formed from an internal refraction of light in different directions as the light passes through the second material layer, thereby creating a visual appearance of dynamic movement of the predetermined or random pattern relative to a surface or an area in three-dimensional space.

8. A light apparatus, comprising:

a light assembly including an array of light sources to illuminate light, and a control module to control the light assembly;

a housing assembly including an inner housing material layer defining a first faced member connected to an inner housing base having a stepped portion, and an outer housing material layer arranged spaced from the inner housing material layer to refract and project the light emitted by the light sources in a predetermined or random direction and predetermined or random pattern, the outer housing having an outer housing material layer defining a second faceted member and an opening; and a carrier received at and supported by the opening of the outer housing, the carrier including rings that are configured to receive and support the inner housing at the stepped portion and thereby suspend the inner housing and the light assembly in the outer housing.

9. The light apparatus of claim 8, wherein:

the inner housing material layer comprises a translucent material or a transparent material; and the outer housing material layer comprises a translucent material or a transparent material.

10. The light apparatus of claim 8, wherein the light assembly comprises:

a power source including one of a solar power source, a battery power source, or an AC adapter power source; and a printed circuit board operatively connected to the light sources.

11. The light apparatus of claim 8, wherein the control module comprises a processor and a computer readable storage medium to store a set of instructions which, if executed by the control module, cause the control module to wirelessly control the light assembly.

12. The light apparatus of claim 8, wherein the control module comprises a processor and a computer readable storage medium to store a set of instructions which, if executed by the control module, cause the control module to control a sequence of light and an intensity of light emitted from each light source in the array.

13. The light apparatus of claim 8, wherein the predetermined or random pattern comprises a patterned shadow formed from an internal refraction of light in different directions as the light passes through the second material layer, thereby creating a visual appearance of dynamic movement of the predetermined or random pattern relative to a surface or an area in three-dimensional space.

14. A light apparatus, comprising:

a light assembly including an array of light sources to illuminate light, and a control module having a processor and a computer readable storage medium to store a set of instructions which, if executed by the control module, cause the control module to variably control a sequencing of light and an intensity of light emitted from each light source in the array;

an inner housing including a first material layer connected to an inner housing base having a stepped portion, the inner housing base to receive the light assembly and thereby permit emission of light from the light sources through the first material layer;

an outer housing including an opening and a second material layer arranged spaced from the first material layer, the second material layer member having a plurality of projections extending outwardly at various angles to refract and project the light emitted through the inner housing in a predetermined or random direction and a predetermined or random pattern; and a carrier received at and supported by the opening of the outer housing, the carrier including rings that are configured to receive and support the inner housing at the stepped portion and thereby suspend the inner housing and the light assembly in the outer housing.

15. The light apparatus of claim 14, wherein:

the inner housing is composed of a translucent material or a transparent material; and the outer housing is composed of a translucent material or a transparent material.

16. The light apparatus of claim 14, wherein the set of instructions which, if executed by the control module, cause the control module to wirelessly control the light assembly.

17. The light apparatus of claim 14, wherein the set of instructions which, if executed by the control module, cause the control module to variably control a transition time between a sequencing of light and an intensity of light emitted from each light source in the array.

18. The light apparatus of claim 14, wherein the predetermined or random pattern comprises a patterned shadow formed from an internal refraction of light in different directions as the light passes through the at least one second material layer, thereby creating a visual appearance of dynamic movement of the predetermined or random pattern relative to a surface or an area in three-dimensional space.

* * * * *